US005999769A

United States Patent [19]

Anderson et al.

[11] Patent Number: 5,999,769

[45] Date of Patent: Dec. 7, 1999

[54] FILTERING SYSTEM FOR REMOVING TONER FROM AN AIR STREAM IN A DEVELOPMENT HOUSING

[75] Inventors: David G. Anderson, Ontario; Joseph Fantuzzo, Webster, both of N.Y.

[73] Assignee: Xerox Corporation, Stamford, Conn.

[21] Appl. No.: 09/196,594

[22] Filed: Nov. 20, 1998

[51] Int. Cl.[6] ..... G03G 21/20

[52] U.S. Cl. ..... 399/93; 55/300; 55/304; 55/385.4; 399/99

[58] Field of Search ..... 399/92, 93, 98, 399/99, 252; 55/300, 304, 385.1, 385.2, 385.4

[56] References Cited

U.S. PATENT DOCUMENTS 4,792,344 12/1988 Belcher et al. ..... 55/304

4,868,600 9/1989 Hays et al. ..... 399/266

5,146,279 9/1992 Seyfried ..... 399/93

*Primary Examiner*—Sandra Brase

*Assistant Examiner*—William A. Noe

*Attorney, Agent, or Firm*—Lloyd F. Bean II

[57] ABSTRACT

An electrophotographic printing machine of the type in which an electrostatic latent image recorded on a charge retentive surface is developed with toner particles to form a visible image thereof, including; a housing having a supply of toner and developer therein; a donor member for transporting toner from the housing to the development zone; a means for conveying toner to the donor member; blower for generating a negative air stream for carrying toner therein; and a filter for removing the toner from the negative air stream, the filter including filter material and spring blower, connected thereto, for oscillating the filter material to dislodge toner material collected in the filter when the generating means is disabled.

5 Claims, 3 Drawing Sheets

FILTERING SYSTEM FOR REMOVING TONER FROM AN AIR STREAM IN A DEVELOPMENT HOUSING

BACKGROUND OF THE INVENTION

This invention relates generally to the development of electrostatic images, and more particularly concerns a development system having an electrostatic filtering system which allows a steady flow of air into a development housing and prevents toner emission therefrom.

The invention can be used in the art of electrophotographic printing. Generally, the process of electrophotographic printing includes sensitizing a photoconductive surface by charging it to a substantially uniform potential The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration.

Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface.

There are various known development systems for bringing toner particles to a latent image on a photoconductive surface. Single component development systems use a donor roll for transporting charged toner to the development nip defined by the donor roll and the photoconductive surface. The toner is developed on the latent image recorded on the photoconductive surface by a combination of mechanical scavengeless development. A scavengeless development system uses a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image. In another type of scavengeless system, a magnetic developer roll attracts developer from a reservoir. The developer includes carrier and toner. The toner is attracted from the carrier to a donor roll. The donor roll then carries the toner into proximity with the latent image.

One method of controlling toner emissions from developer housings in xerographic equipment is to relieve any positive pressure generated in the housing. Moving components such as the magnetic brush rolls and the mixing augers can pump air into the housing, causing slight positive pressures. These positive pressures can result in air flow out of the housing via low impedance leakage paths. This air escaping from the housing contains entrained toner and is a major potential source of dirt within the system. A common approach to relieving this pressure is through the use of a "sump sucker". In its simplest form a sump sucker is a simple port into the air space above the developer material in the housing. This lowers the pressure in the housing below atmospheric pressure, therefore air flows into, rather than out of any low air impedance leakage paths within the housing. This toner laden air is drawn through a tube to a filter/waste sump assembly. A shortcoming of this system involves the waste toner removed from the system with this air flow. The amount of toner withdrawn from the system has a direct negative effect on total systems efficiency by increasing the total amount of waste toner, resulting in increased cost of ownership to the customer. Further, toner particle size distributions and additive concentrations can be affected if there is preferential air entrainment of some particles.

Further, the scavengeless development housings have decreased in size, thus, increasing magnetic roll speeds have been required to obtain adequate developability or donor reload in the case of HSD. Under these conditions toner emissions have increased and are considered a serious problem.

BRIEF SUMMARY OF THE INVENTION

In accordance with one object of the present invention, there is provided an electrostatic filtering system which allows a steady flow of air into a development housing and prevents toner emission therefrom.

There is provided an electrophotographic printing machine of the type in which an electrostatic latent image recorded on a charge retentive surface is developed with toner particles to form a visible image thereof, comprising: a housing having a supply of toner and developer therein; a donor member for transporting toner from said housing to the development zone; a means for conveying toner to the donor member; means for generating a negative air stream for carrying toner therein; and a filter for removing the toner from the negative air stream, said filter including filter material and spring means, connected thereto, for oscillating said filter material to dislodge toner material collected in said filter when said generating means is disabled.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
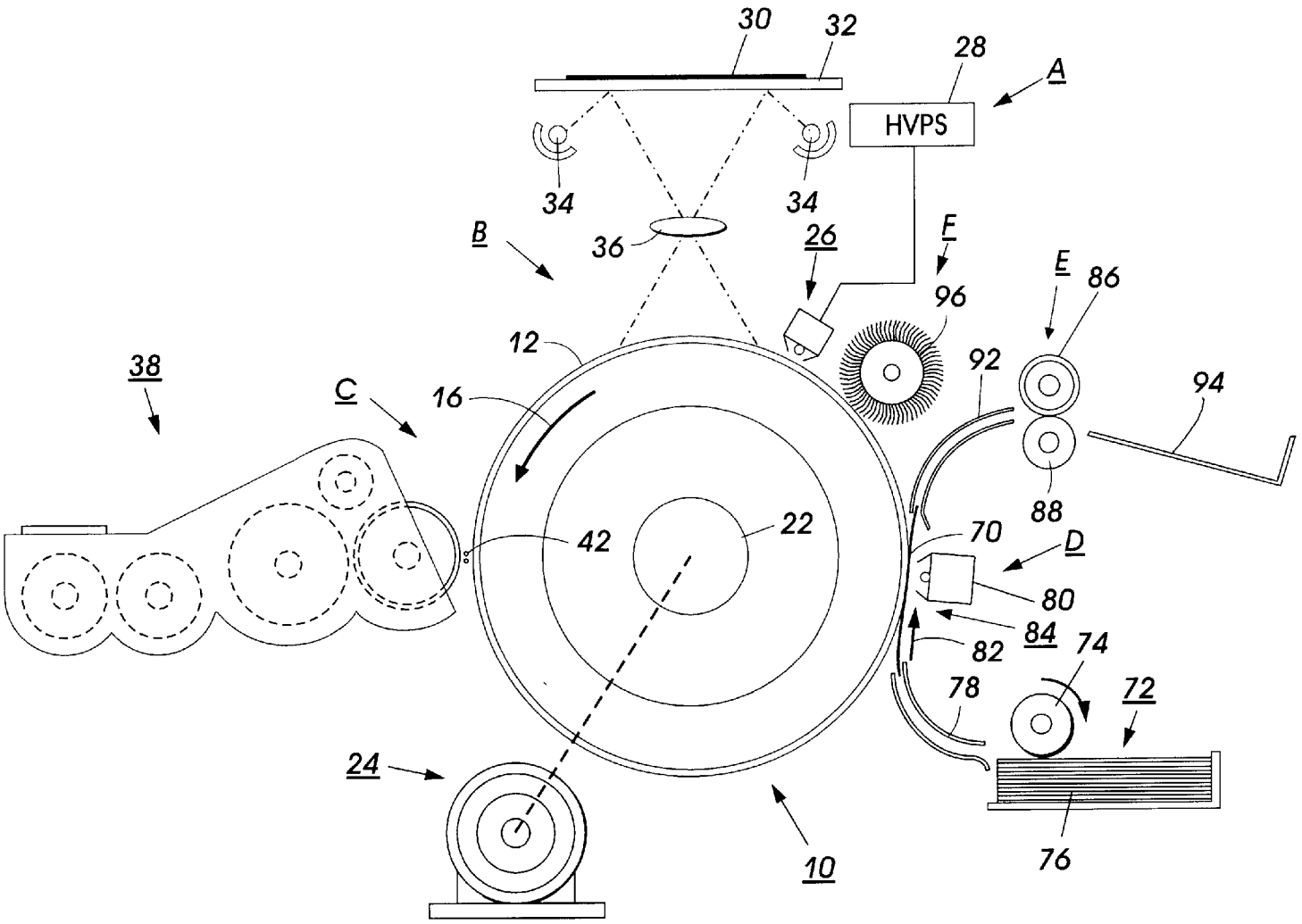
FIG. 1 is a schematic elevational view of an illustrative electrophotographic printing machine incorporating a developer unit having the features of the present invention therein.

Referring initially to FIG. 1, there is shown an illustrative electrophotographic printing machine incorporating the development apparatus of the present invention therein. The electrophotographic printing machine employs a drum 10 having a photoconductive surface 12 deposited on a conductive substrate. Preferably, photoconductive surface 12 is made from selenium alloy. The conductive substrate is made preferably from an aluminum alloy that is electrically grounded. One skilled in the art will appreciate that any suitable photoconductive drum may be used. Drum 10 moves in the direction of arrow 16 to advance successive portions of photoconductive surface 12 sequentially through the various processing stations disposed throughout the path of movement thereof. Motor 24 rotates drum 10 in the direction of arrow 16. Roller 22 is coupled to motor 24 by suitable means, such as a drive drum.

Initially, a portion of drum 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of drum 10. After photoconductive surface 12 of drum 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, drum 10 advances the latent image to development station C. At development station C, a developer unit, indicated generally by the reference numeral 38, develops the latent image recorded on the photoconductive surface. Preferably, developer unit 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roll 40 is mounted, at least partially, in the chamber of the developer housing. The chamber in the developer housing stores a supply of developer material. In one embodiment the developer material is a single component development material of toner particles, whereas in another, the developer material includes at least toner and carrier.

With continued reference to FIG. 1, after the electrostatic latent image is developed, drum 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of drum 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of drum 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
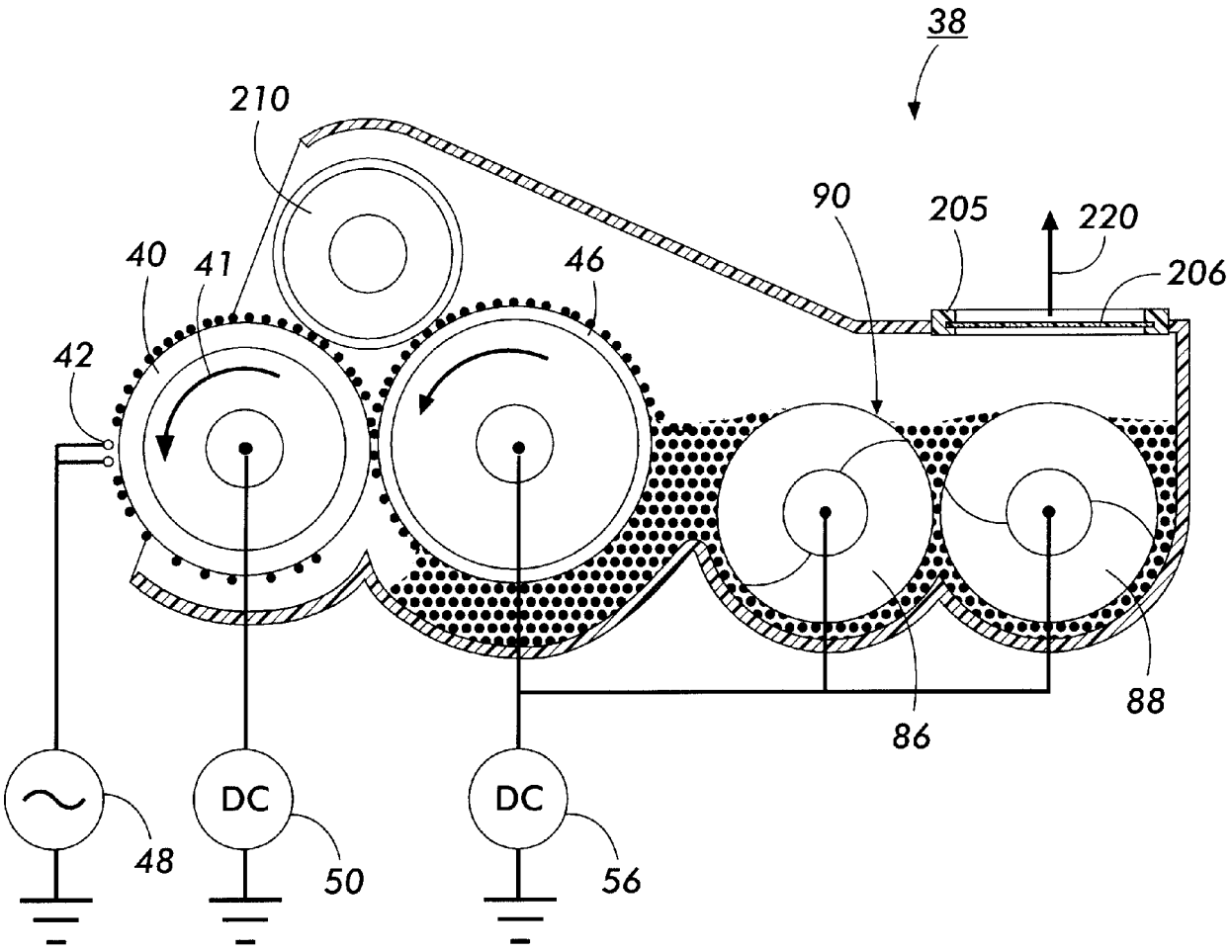
FIG. 2 is a schematic elevational view showing one embodiment of the developer unit used in the FIG. 1 printing machine.

Referring now to FIG. 2, there is shown one embodiment of the present invention in greater detail. The development system 38 includes a donor roll 40, electrode wires 42, and metering and magnetic roll 46. The donor roll 40 attracts toner from the reservoir and roll 46 supplies charged toner to the donor roll 40. The donor roll 40 can be rotated in either the 'with' or 'against' direction relative to the direction of motion of drum 10. The donor roll is shown rotating in the direction of arrow 41. Augers 88 and 86 mix developer material, which is supplied to magnetic roll 46 and 210.

The developer apparatus 38 further has electrode wires 42 located in the space between photoconductive surface 12 and donor roll 40, as described in U.S. Pat. No. 4,868,600. The electrode wires 42 include one or more thin metallic wires which are lightly positioned against the donor roll 40. The distance between the wires 42 and the donor roll 40 is approximately the thickness of the toner layer on the donor roll 40. The extremities of the wires are supported by the tops of end bearing blocks (not shown) which also support the donor roll 40 for rotation.

An electrical bias is applied to the electrode wires by a voltage source 48. The bias establishes an electrostatic field between the wires 42 and the donor roll 40 which is effective in detaching toner from the surface of the donor roll 40 and forming a toner cloud about the wires 42, the height of the cloud being such as not to contact with the photoconductive surface 12.

A DC bias supply 50 establishes an electrostatic field between the photoconductive surface 12 and the donor roll 40 for attracting the detached toner particles from the cloud surrounding the wires 42 to the latent image on the photoconductive surface 12. Before the transfer of toner from the magnetic roll 46 to the donor roll 40, a cleaning blade (not shown) strips all of the toner from donor roll 40 so that magnetic roll 46 meters fresh toner to a clean donor roll. Then a DC bias supply 56 establishes an electrostatic field between magnetic roll 46 and donor roll 40 which causes toner particles to be attracted from the magnetic roll to the donor roll. A metering blade (not shown) can be positioned closely adjacent to magnetic roll 46 to maintain the compressed pile height of the developer material on magnetic roll 46 at the desired level.

Magnetic roll 46 includes a non-magnetic tubular member or sleeve made preferably from aluminum and having the exterior circumferential surface thereof roughened. An elongated multiple magnet is positioned interiorly of and spaced from the tubular member. Elongated magnet is mounted on bearings and coupled to the motor. The sleeve may also be mounted on suitable bearings and coupled to the motor. Toner particles are attracted from the carrier granules on the magnetic roll to the donor roll. A scraper blade removes denuded carrier granules and extraneous developer material from the surface of the sleeve.

As successive electrostatic latent images are developed, the toner particles within the developer material are depleted. Augers are mounted rotatably to mix fresh toner particles with the remaining developer material so that the resultant developer material therein is substantially uniform with the concentration of toner particles being optimized.

Figure 3:
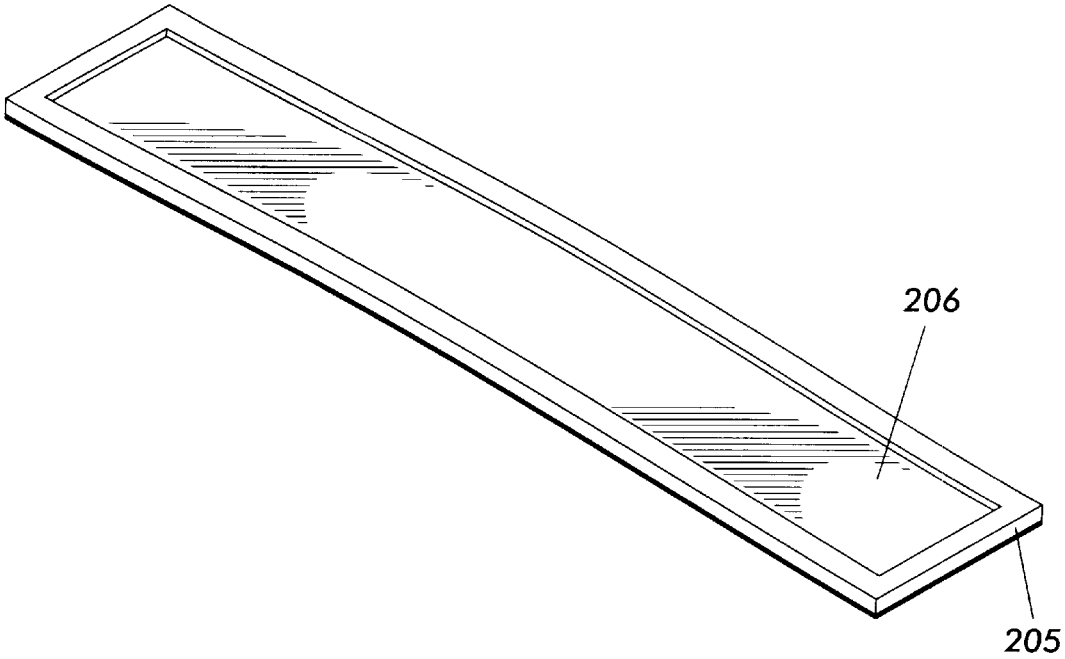
FIGS. 3 and 4 are illustrations of the filter used with the present invention.
Figure 4:
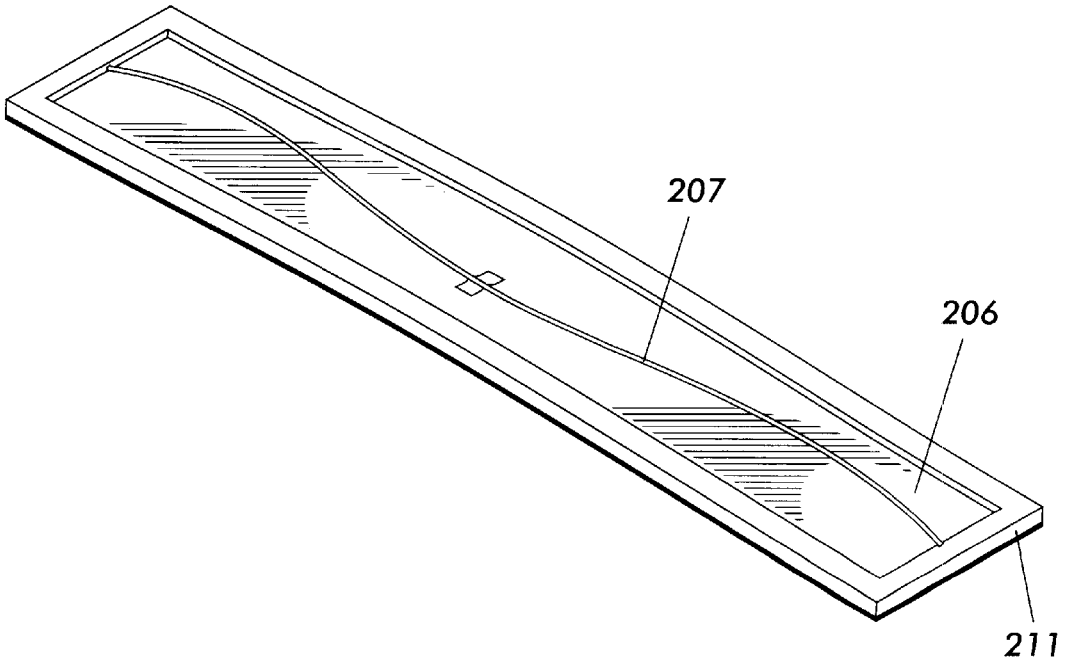

The filter 204 is placed in the housing in such a position and orientation as shown schematically in FIG. 4. Filter 204 includes a rigid frame 205 and filter material 206. Preferable filter materials employed with the present invention are submicron filters, made from expanded Teflon which stops toner from passing therethrough. The average toner particle size is 7 microns. Therefore, the toner will sit on the surface of the membrane and not penetrate the material. A spring 207 is placed across filter material 206 as shown in FIG. 3. A negative pressure is applied to the back side of the filter via a vacuum source and suitable ducting of the air flow in the housing is illustrated in arrows 220. The negative air pressure causes filter material 206 along with spring 207 to be deflected as toner becomes lodged into filter material 206. When the vacuum source is turned off spring 207 oscillates to dislodge the material collected on the filter surface in the absence of the holding forces associated with the airflow 220 through the filter. The toner is returned to the augers where the toner can be reused.

A second embodiment is shown in FIG. 3, filter 204 includes a flexible frame 211 and filter material 206 as the negative air pressure causes filter material 206 along with frame 211 to be deflected as toner becomes lodged into filter material 206. When the vacuum source is turned off, frame 211 oscillates to dislodge the material collected on the filter surface in the absence of the holding forces associated with the airflow 220 through the filter.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An electrophotographic printing machine of the type in which an electrostatic latent image recorded on a charge retentive surface is developed with toner particles to form a visible image thereof, comprising:

a housing having a supply of toner and developer therein;

a donor member for transporting toner from said housing to a development zone;

a means for conveying toner to the donor member;

means for generating a negative air stream for carrying toner therein; and a filter for removing the toner from the negative air stream, said filter including filter material and spring means, connected thereto, for oscillating said filter material to dislodge toner material collected in said filter when said generating means is disabled.

2. The printing machine of claim 1, wherein said filter is a submicron filter, made from expanded Teflon which stops toner from passing therethrough.

3. The printing machine of claim 1, wherein said spring means includes a spring in contact with said filter material.

4. The printing machine of claim 1, wherein said spring means includes a frame for supporting said filter material.

5. The printing machine of claim 1, wherein said negative air stream means comprises a blower.

* * * * *